US010222170B2

(12) United States Patent
Bonine

(10) Patent No.: US 10,222,170 B2
(45) Date of Patent: Mar. 5, 2019

(54) COMPACT UPPER RECEIVER RECOIL SYSTEMS AND METHODS

(71) Applicant: David Kristopher Bonine, Grants Pass, OR (US)

(72) Inventor: David Kristopher Bonine, Grants Pass, OR (US)

( * ) Notice: Subject to any disclaimer, the term of this patent is extended or adjusted under 35 U.S.C. 154(b) by 0 days.

(21) Appl. No.: 15/642,914

(22) Filed: Jul. 6, 2017

(65) Prior Publication Data

US 2018/0010879 A1 Jan. 11, 2018

Related U.S. Application Data

(60) Provisional application No. 62/358,774, filed on Jul. 6, 2016.

(51) Int. Cl.

| | |
|---|---|
| ***F41A 3/84*** | (2006.01) |
| ***F41C 23/06*** | (2006.01) |
| ***F41A 3/66*** | (2006.01) |
| ***F41A 3/72*** | (2006.01) |
| ***F41A 3/86*** | (2006.01) |
| ***F41A 5/18*** | (2006.01) |

(52) U.S. Cl.

CPC ..... *F41C 23/06* (2013.01); *F41A 3/66* (2013.01); *F41A 3/72* (2013.01); *F41A 3/84* (2013.01); *F41A 3/86* (2013.01); *F41A 5/18* (2013.01)

(58) Field of Classification Search

CPC ..... F41A 3/82; F41A 3/84; F41A 3/86; F41A 3/72

See application file for complete search history.

(56) References Cited

U.S. PATENT DOCUMENTS

| | | | | |
|---|---|---|---|---|
| 2,167,672 A * | 8/1939 | Nomar | F41A 3/38 | 89/132 |
| 7,469,496 B1 * | 12/2008 | Kellgren | F41A 15/10 | 42/46 |
| 2013/0036900 A1 * | 2/2013 | Mueller | F41A 3/84 | 89/191.01 |

FOREIGN PATENT DOCUMENTS

FR 885.433 * 5/1943

* cited by examiner

*Primary Examiner* — Stephen Johnson

(74) *Attorney, Agent, or Firm* — Eversheds Sutherland (US) LLP

(57) ABSTRACT

A firearm recoil system is disclosed. The firearm recoil system may include first and second guide rods attached to a bolt carrier group. The first and second guide rods may extend forward through an upper receiver. The firearm recoil system also may include first and second recoil springs. The first recoil spring may be disposed around the first guide rod, and second recoil spring may be disposed around the second guide rod.

17 Claims, 8 Drawing Sheets

COMPACT UPPER RECEIVER RECOIL SYSTEMS AND METHODS

CROSS-REFERENCE TO RELATED APPLICATIONS

The disclosure claims priority to and the benefit of U.S. provisional patent application No. 62/358,774, filed Jul. 6, 2016, which is incorporated by reference herein in its entirety.

FIELD OF THE DISCLOSURE

The disclosure generally relates to firearms and more particularly relates to firearm recoil systems and methods, such as a compact upper receiver recoil system and method.

BACKGROUND

Recoil results from forces generated by the gases that propel a projectile, such as a bullet, out of the barrel of a firearm. Typically, firearms include recoil systems to manage and harness energy from the recoil. These recoil systems, however, may be large and cumbersome. Accordingly, there is a need for a firearm recoil system that enables the firearm to be configured without a rearward recoil spring, buffer, and buffer tube, thereby reducing the overall length and weight of the firearm.

SUMMARY

According to an embodiment, a firearm recoil system is disclosed. The firearm recoil system may include first and second guide rods attached to a bolt carrier group. The first and second guide rods may extend forward through an upper receiver. The firearm recoil system also may include first and second recoil springs. The first recoil spring may be disposed around the first guide rod, and second recoil spring may be disposed around the second guide rod.

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

DETAILED DESCRIPTION

The disclosure is directed a firearm recoil system. Methods of manufacture and use of the recoil system are also disclosed. The recoil system disclosed herein may be incorporated into any firearm. The firearm may be a conventional firearm. For example, the firearm may be an M-16 style rifle, an AR-15 style rifle, an AR-10 style rifle, or an M-4 style rifle, among others. In some instances, the recoil system may be an AR-15 coil spring recoil system that includes two parallel guide rods that are attached directly to the bolt carrier group via an adapter and extend forward through the upper receiver. Two parallel coil springs may be disposed on the two parallel guide rods.

The systems and methods disclosed herein may allow the AR-15 to be configured without a rearward recoil spring, buffer, and buffer tube. In addition, the systems and methods disclosed herein may enable the AR-15 to be configured with a direct impingement gas cycling system. Furthermore, the systems and methods disclosed herein may enable the upper receiver to maintain compatibility with all AR-15 lower receivers. The recoil system may be used in conjunction with any suitable firearm or firearm platform.

Some benefits and/or technical solutions of recoil system, particularly when incorporated into an AR-15 platform, include, among other things, reducing the overall length of the AR-15, reducing the overall weight of the AR-15, allowing broader design options for shoulder stocks to be mounted to the lower receiver, and allowing the AR-15 to be configured into a pistol without a buffer tube extending rearward from the lower receiver. The above advantages are described in connection with the recoil system being incorporated into an AR-15 platform. The recoil system, however, may be applied to larger style firearms of the same design, such as the AR-10 .308 caliber platform, among others. The recoil system may be used in conjunction with any suitable firearm or firearm platform.

Figure 1A:
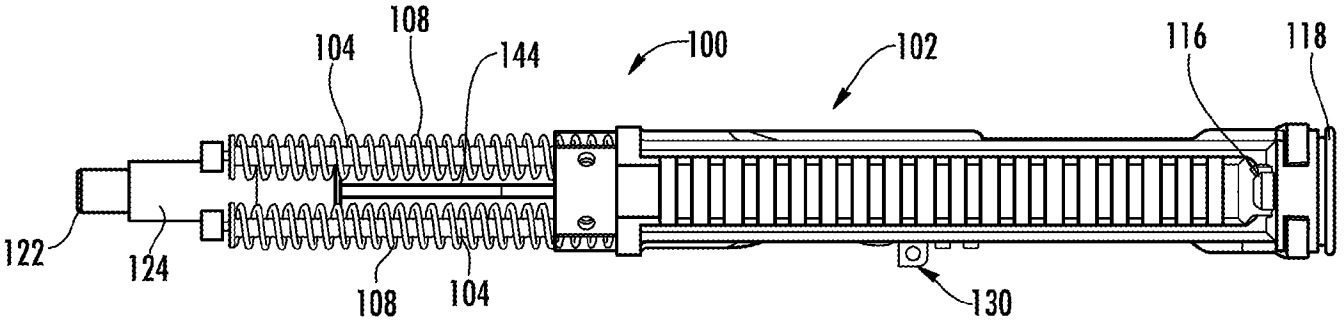
FIG. 1A depicts a top view of a firearm recoil system in accordance with one or more embodiments of the disclosure.
Figures 6A, 6B:
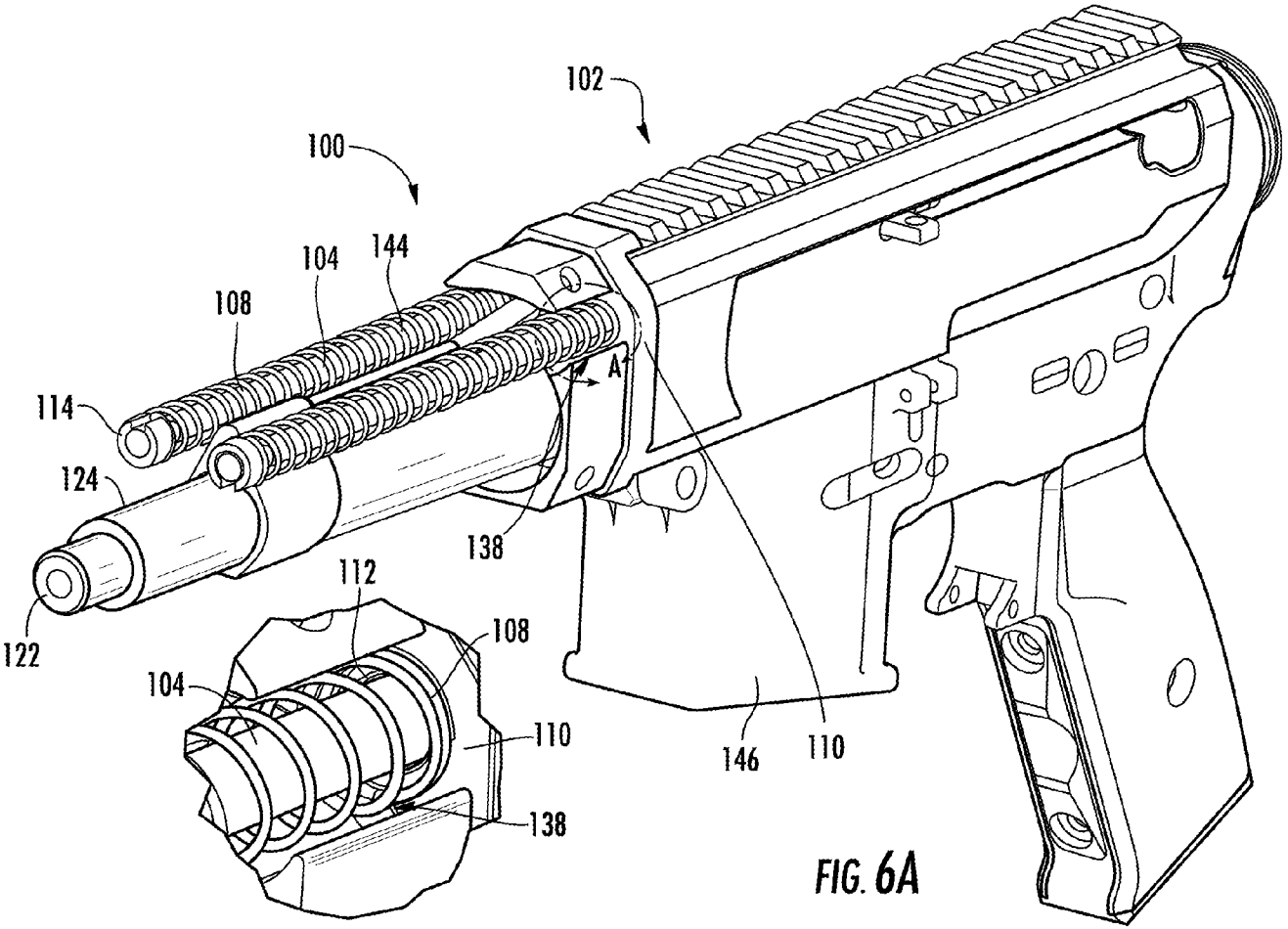
FIG. 6A depicts a perspective view of a firearm recoil system in accordance with one or more embodiments of the disclosure.
FIG. 6B depicts a detailed view of a firearm recoil system in accordance with one or more embodiments of the disclosure.
Figure 7:
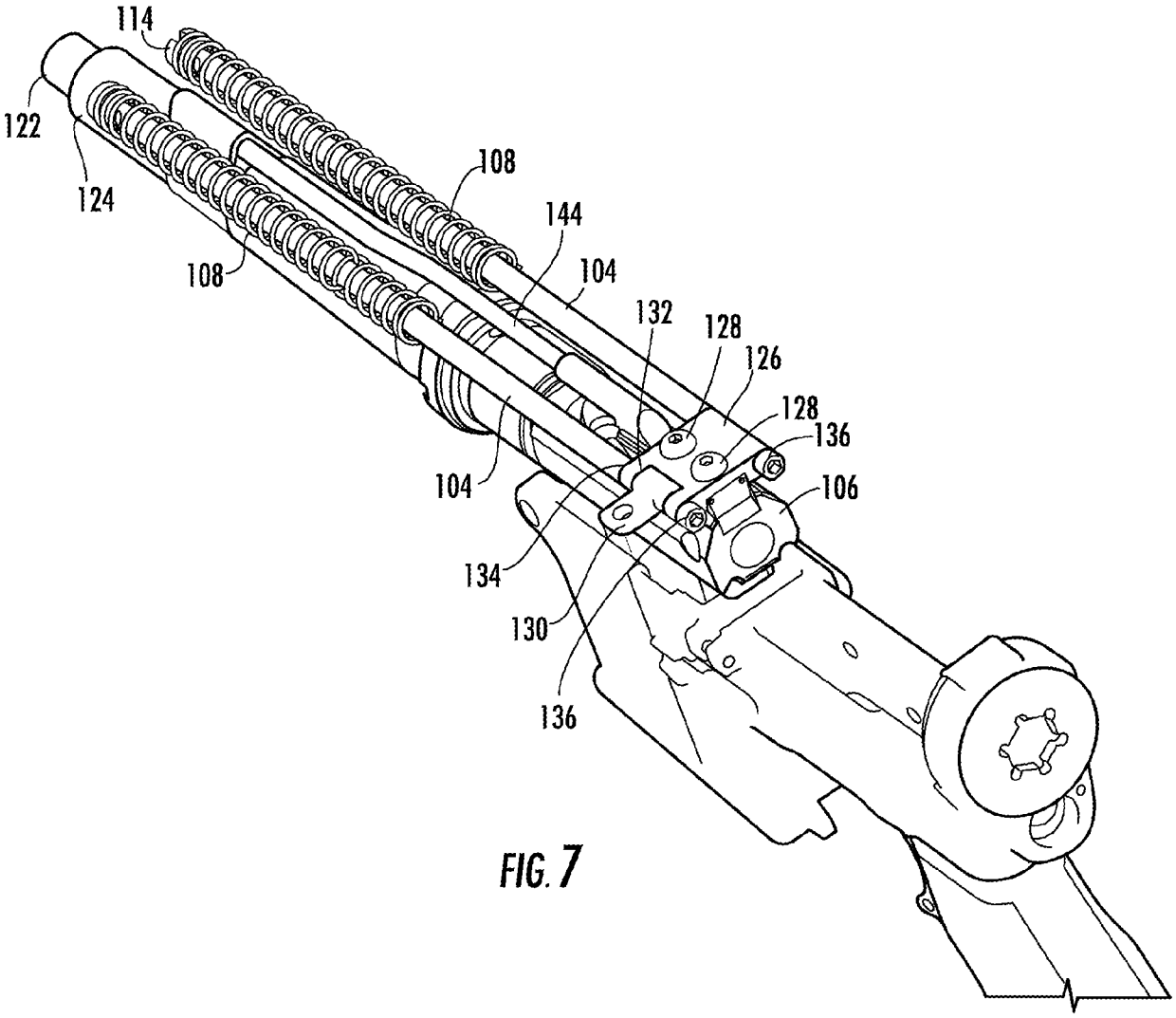
FIG. 7 depicts a perspective view of a firearm recoil system in accordance with one or more embodiments of the disclosure.

FIGS. 1A-8 depict a recoil system 100 or portions thereof. FIGS. 1A and 1B depict the recoil system 100 installed on an upper receiver 102 of a firearm. In some instances, the firearm may include an AR-15 style platform. The upper receiver 102 may be machined to accept the passage of two guide rods 104 therethrough. In some instances, the guide rods 104 may be disposed on opposite sides of a gas tube 144. The guide rods 104 may be any suitable size, shape, or configuration. As depicted in FIG. 7, the guide rods 104 may be attached to a bolt carrier group 106. For example, the guide rods 104 may be attached to the bolt carrier group 106 via an adapter 126. The guide rods 104 may extend from the bolt carrier group 106 toward the front of the upper receiver 102. Each of the guide rods 104 may include a recoil spring 108 positioned around the guide rods 104.

Figure 1B:
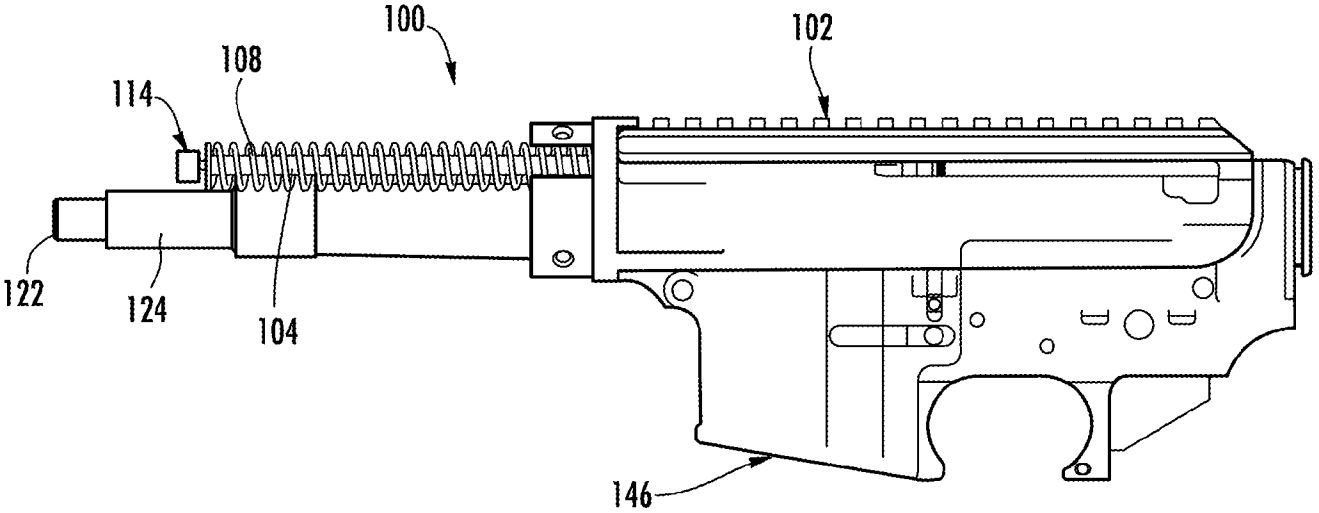
FIG. 1B depicts a side view of a firearm recoil system in accordance with one or more embodiments of the disclosure.
Figure 2:
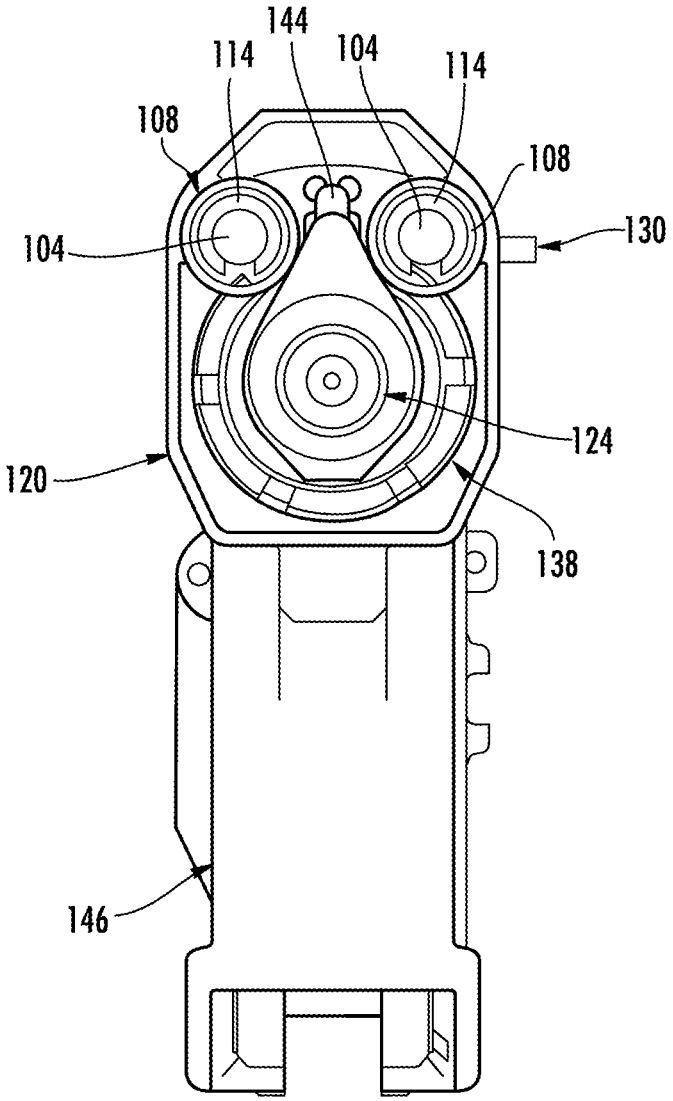
FIG. 2 depicts a front view of a firearm recoil system in accordance with one or more embodiments of the disclosure.
Figure 3:
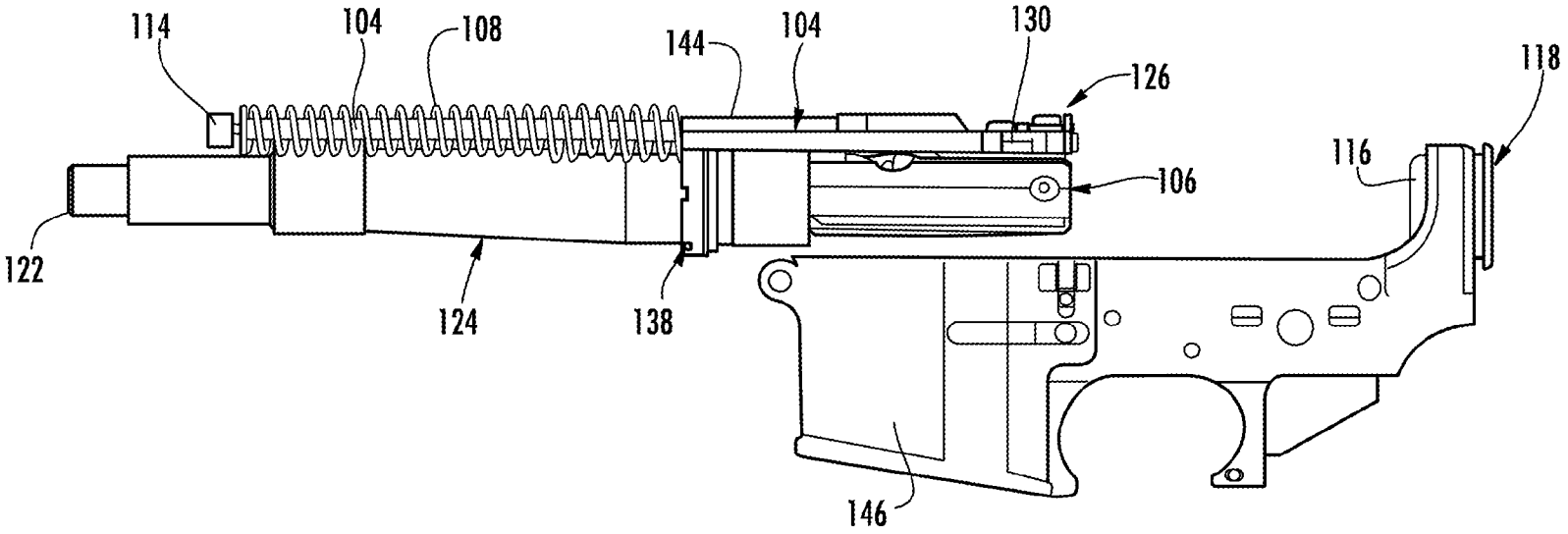
FIG. 3 depicts a side view of a firearm recoil system in accordance with one or more embodiments of the disclosure.

The recoil system 100 is depicted in the relaxed state in FIGS. 1A and 1B. That is, the recoil springs 108 are not fully compressed. As depicted in FIGS. 6A and 6B, the reward ends of the recoil springs 108 may rest against a face 110 of the upper receiver 102 and/or a barrel nut 138. The guide rods 104 may pass through holes 112 in the face 110 of the upper receiver 102. The recoil springs 108 may rest against the face 110 of the upper receiver 102 around the holes 112. The recoil springs 108 may be captured at the forward end of the guide rods 104 with a removable retainer 114. As noted above, the rearward ends of the guide rods 104 may be attached to the bolt carrier group 106.

Figure 4A:
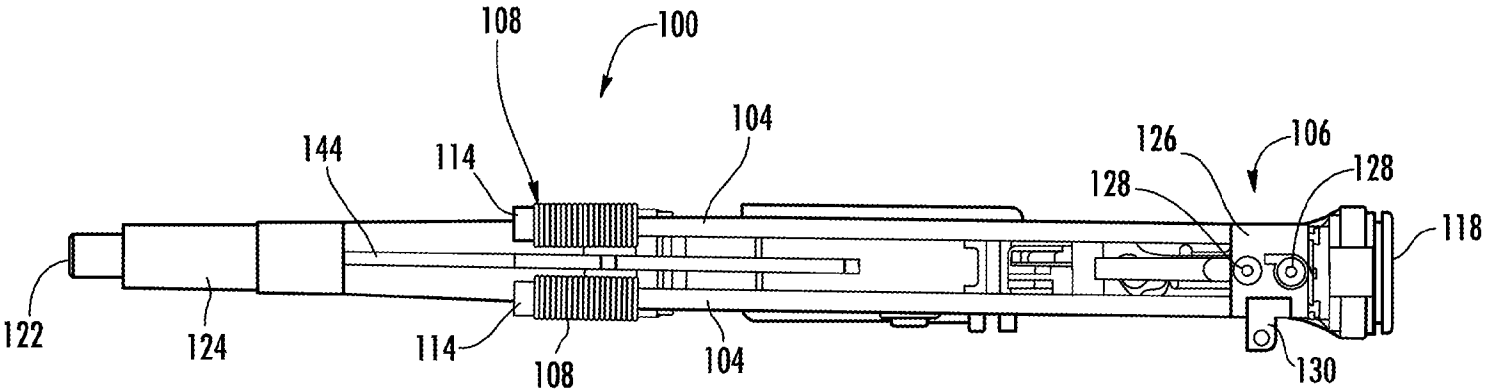
FIG. 4A depicts a top view of a firearm recoil system in accordance with one or more embodiments of the disclosure.
Figure 4B:
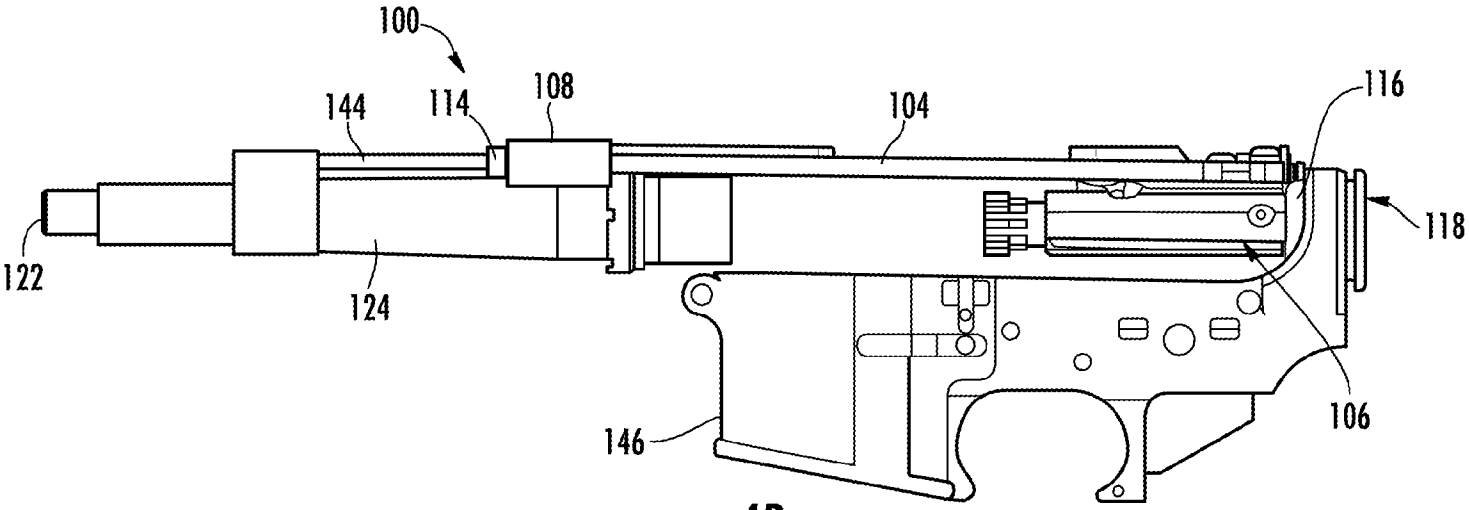
FIG. 4B depicts a side view of a firearm recoil system in accordance with one or more embodiments of the disclosure.

When the firearm is fired, the direct impingement gas system forces the bolt carrier group 106 rearward, thereby compressing the recoil springs 108 around the guide rods 104 between the face 110 of the upper receiver 102 and/or barrel nut 138 and the removable retainers 114. FIGS. 4A and 4B depict the recoil system 100 in the compressed state. In some instances, when the recoil system 100 is compressed, the excess inertia of the bolt carrier group 106 may be countered by a rubber cushion 116 positioned on a face of a lower receiver plug 118 in the lower receiver 146. Once the inertia of the bolt carrier group 106 has been absorbed, the recoil springs 108 may return the bolt carrier group 106 forward to the repose state.

Figure 5:
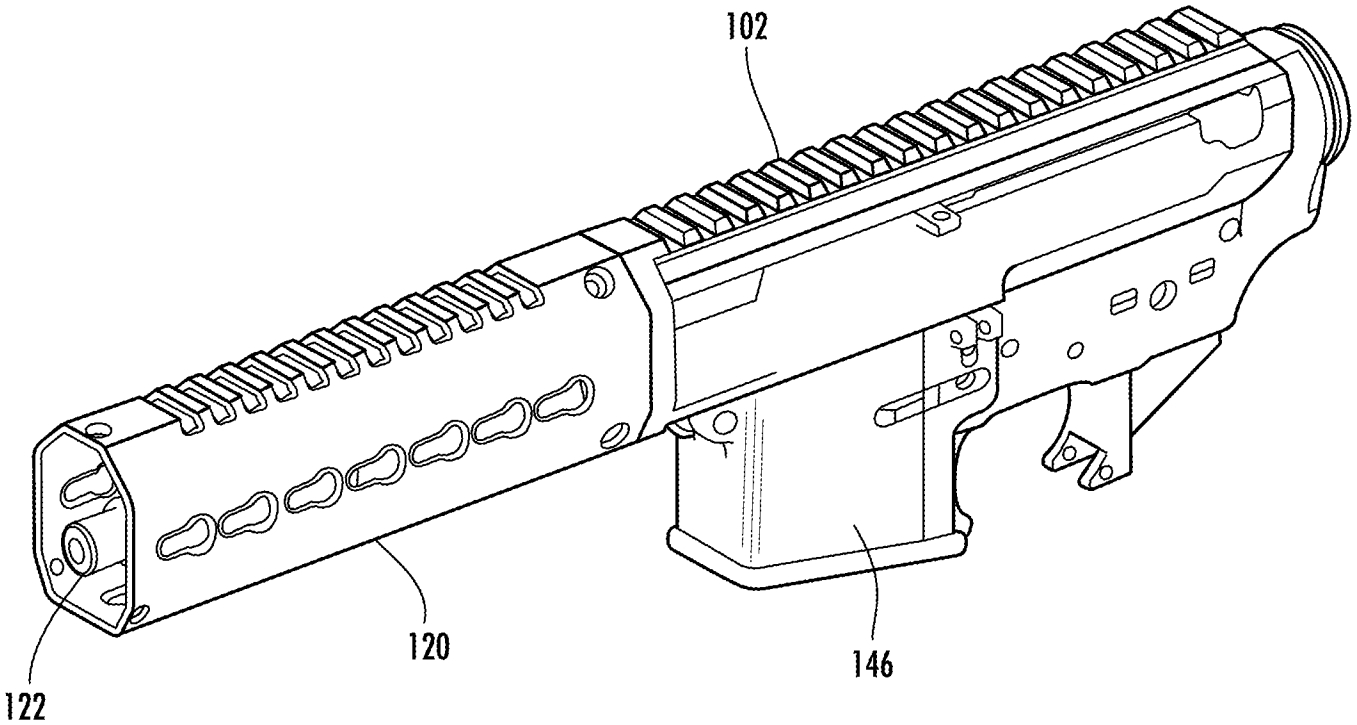
FIG. 5 depicts a perspective view of a firearm recoil system in accordance with one or more embodiments of the disclosure.

FIG. 5 depicts the recoil system 100 concealed under a tubular handguard 120. For example, the tubular handguard 120 may be attached to the upper receiver 102 and extend forward passed the forward ends of the guide rods 104. In some instances, the tubular handguard 120 may extend up to a muzzle end 122 of a barrel 124 of the firearm. The tubular handguard 120 may be any suitable size, shape, or configuration.

In certain embodiments, the guide rods 104 may be about 9.24". The guide rods 104 may be any length between about 9.0" and 10.0". The guide rods 104 can be any suitable length. In some instances, the recoil springs 108 may include a weight of about 17 lbs, with an acceptable range of about 11-25 lbs depending on ammunition and the guide rods 104 length. The recoil springs 108 may be any suitable weight. In some instances, the recoil springs 108 may comprise a flat wire (e.g., auger style) spring so that the recoils springs 108 do not over compress and bottom out before reaching the full stroke, particularly when the compression distance and spring weight are specified to about 9.24" with about 17 lbs force.

As noted above, FIG. 7 shows the guide rods 104 attached to the bolt carrier group 106. In one example embodiment, the guide rods 104 may be attached to the bolt carrier group 106 via an adapter 126. The adapter 126 may utilize the existing gas key screw holes in the top of the bolt carrier group 106. That is, one or more screws 128 may pass through one or more holes in the adapter 126 and into the existing gas key screw holes in the top of the bolt carrier group 106 in order to attach the adapter 126 to the bolt carrier group 106. In some instances, due to the addition of the adapter 14, longer gas key screws 128 may be used. The adapter may be any suitable size, shape, or configuration.

In certain embodiments, at least one of guide rods 104 may passes through a charging handle 130. As depicted in FIG. 7, the left guide rod 104 is attached to the charging handle 130. The charging handle 130 may be attached to either guide rod 104. In some instances, the charging handle 130 may include a bore in which the guide rod 104 passes through. The charging handle 130 may be any suitable size, shape, or configuration. A portion of the charging handle 130 may be located in a cutout 132 in the adapter 126 in order to maintain the position of the charging handle 130 and prevent the charging handle 130 from sliding along the guide rod 104.

The guide rods 104 may be attached to the adapter 126. For example, the guide rods 104 may pass through holes 134 in the adapter 126. The rearward ends of the guide rods 104 may be secured to the adapter 126 using a screw 136 or other attachment means. For example, the guide rods 104 may include a close fit into the adapter 126, and the rearward ends of the guide rods 104 may be secured to the adapter 126 using hardened screws threaded in the rearward ends of the guide rods 104.

In some instances, the distance of the guide rods 104 longitudinal axes above the bore centerline may have an effect on the tilt of the bolt carrier group 106. In this manner, the distance may be reduced to the minimum height possible without interfering with the ejection of the spent cartridge when cycling the firearm. The tilt of the bolt carrier group 106 is due to the deflection of the guide rods 104. With this consideration, the guide rods 104 may be made from a high strength alloy, such as heat treated A2 tool steel or hardened 4140 alloy steel to reduce deflection to a minimum. The guide rods 104 may comprise any suitable material.

Figure 8:
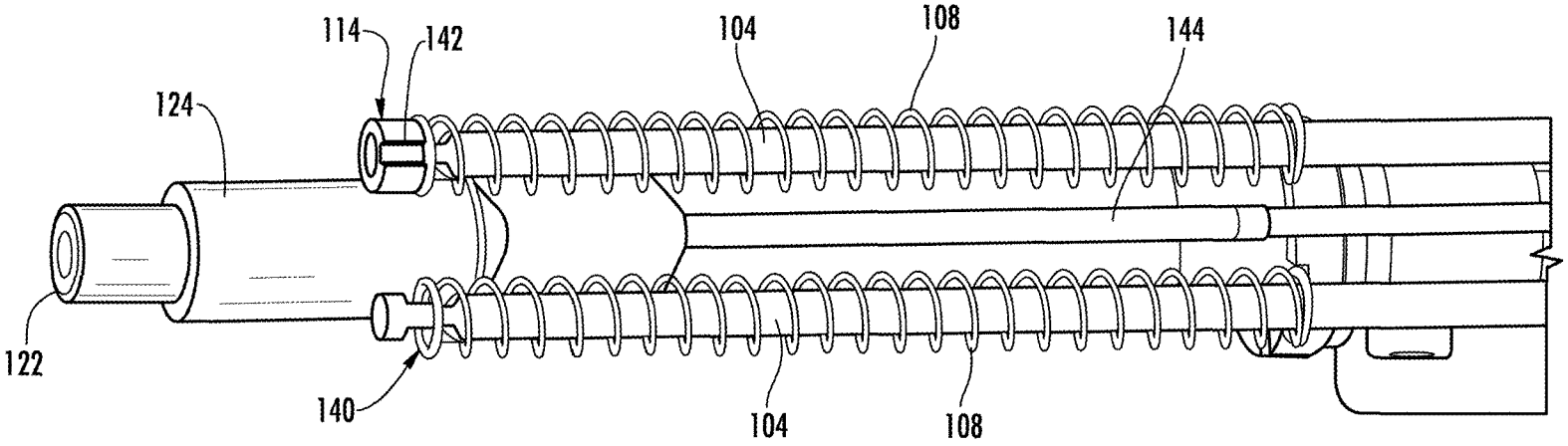
FIG. 8 depicts a top view of a firearm recoil system in accordance with one or more embodiments of the disclosure.

FIG. 8 depicts the forward end of the recoil system 100. In some instances, the removable retainers 114 may comprise a washer style capture device that slides over a machined relief 140 near an end of the guide rods 104. For example, the washer style capture device may include a slot 142 configured to slide over the machined relief 140. When pushed forward, the removable retainers 114 may be captured at the end of the guide rods 104. The opposite end of the recoil springs 108, depicted in FIGS. 6A and 6B, rest against one or both of the edge of the barrel nut 138 and the face 110 of the upper receiver 102. That is, the barrel nut 138 may be machined with external threads that include an inside diameter slightly larger than the barrel diameter and with a length that makes the face of the barrel nut 138 flush with the surface 110 of the upper receiver 102 in which the recoil springs 108 rest.

Although specific embodiments of the disclosure have been described, numerous other modifications and alternative embodiments are within the scope of the disclosure. For example, any of the functionality described with respect to a particular device or component may be performed by another device or component. Further, while specific device characteristics have been described, embodiments of the disclosure may relate to numerous other device characteristics. Further, although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," or "may," unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

That which is claimed is:

1. A firearm recoil system, comprising:

first and second guide rods attached to a bolt carrier group, wherein the first and second guide rods extend forward through an upper receiver;

first and second recoil springs, wherein the first recoil spring is disposed around the first guide rod, and wherein the second recoil spring is disposed around the second guide rod;

an adapter configured to attached the first and second guide rods to the bolt carrier group; and a charging handle attached to at least one of the first or second guide rods, wherein a portion of the charging handle is located in a cutout in the adapter.

2. The system of claim 1, wherein the first and second guide rods pass through holes in the adapter and are each secured to the adapter using a respective screw threaded in a rearward end of the first and second guide rods.

3. The system of claim 1, wherein a rearward end of each of the first and second recoil springs rests against a face of the upper receiver and/or a barrel nut.

4. The system of claim 3, wherein each of the first and second guide rods pass through respective holes in the face of the upper receiver.

5. The system of claim 4, wherein each of the first and second recoil springs rest against the face of the upper receiver around the respective holes.

6. The system of claim 5, further comprising a removable retainer disposed about a forward end of each of the first and second guide rods, wherein the removable retainer is configured to maintain each of the first and second recoil springs about the first and second guide rods.

7. The system of claim 6, wherein a forward end of each of the first and second guide rods comprises a machined relief configured to mate with the removable retainer.

8. The system of claim 6, wherein each of the first and second recoil springs are compressible around the first and second guide rods between the face of the upper receiver and/or barrel nut and removable retainers.

9. The system of claim 1, further comprising a rubber cushion positioned on a face of a lower receiver plug in a lower receiver.

10. The system of claim 1, further comprising a tubular handguard attached to the upper receiver and extend forward passed a forward end of the first and second guide rods.

11. A firearm recoil system, comprising:

first and second guide rods attached to a bolt carrier group, wherein the first and second guide rods are parallel to each other and extend forward through an upper receiver;

first and second recoil springs, wherein the first recoil spring is disposed around the first guide rod, and wherein the second recoil spring is disposed around the second guide rod;

an adapter configured to attached the first and second guide rods to the bolt carrier group; and a charging handle attached to at least one of the first or second guide rods, wherein a portion of the charging handle is located in a cutout in the adapter, wherein a rearward end of each of the first and second recoil springs rests against a face of the upper receiver and/or a barrel nut, wherein each of the first and second guide rods pass through respective holes in the face of the upper receiver, wherein each of the first and second recoil springs rest against the face of the upper receiver around the respective holes.

12. The system of claim 11, wherein the adapter is attached to the bold carrier group using existing gas key screw holes in a top of the bolt carrier group.

13. The system of claim 11, further comprising a removable retainer disposed about a forward end of each of the first and second guide rods, wherein the removable retainer is configured to maintain each of the first and second recoil springs about the first and second guide rods.

14. A firearm recoil system, comprising:

first and second guide rods attached to a bolt carrier group, wherein the first and second guide rods extend forward through an upper receiver;

first and second recoil springs, wherein the first recoil spring is disposed around the first guide rod, and wherein the second recoil spring is disposed around the second guide rod; and an adapter configured to attached the first and second guide rods to the bolt carrier group, wherein the first and second guide rods pass through holes in the adapter and are each secured to the adapter using a respective screw threaded in a rearward end of the first and second guide rods.

15. A firearm recoil system, comprising:

first and second guide rods attached to a bolt carrier group, wherein the first and second guide rods extend forward through an upper receiver;

first and second recoil springs, wherein the first recoil spring is disposed around the first guide rod, and wherein the second recoil spring is disposed around the second guide rod; and a removable retainer disposed about a forward end of each of the first and second guide rods, wherein the removable retainer is configured to maintain each of the first and second recoil springs about the first and second guide rods, wherein a rearward end of each of the first and second recoil springs rests against a face of the upper receiver and/or a barrel nut, wherein each of the first and second guide rods pass through respective holes in the face of the upper receiver, and wherein each of the first and second recoil springs rest against the face of the upper receiver around the respective holes.

16. A firearm recoil system, comprising:

first and second guide rods attached to a bolt carrier group, wherein the first and second guide rods extend forward through an upper receiver;

first and second recoil springs, wherein the first recoil spring is disposed around the first guide rod, and wherein the second recoil spring is disposed around the second guide rod; and a rubber cushion positioned on a face of a lower receiver plug in a lower receiver.

17. A firearm recoil system, comprising:

first and second guide rods attached to a bolt carrier group, wherein the first and second guide rods extend forward through an upper receiver;

first and second recoil springs, wherein the first recoil spring is disposed around the first guide rod, and wherein the second recoil spring is disposed around the second guide rod; and a tubular handguard attached to the upper receiver and extend forward passed a forward end of the first and second guide rods.

* * * * *